US005388508A

United States Patent [19]

Dubuit

[11] Patent Number: 5,388,508

[45] Date of Patent: Feb. 14, 1995

[54] SQUEEGEE HEAD, IN PARTICULAR FOR SILKSCREEN PRINTING MACHINES

[75] Inventor: Jean-Louis Dubuit, Paris, France

[73] Assignee: Societe d'Exploitation des Machines Dubuit, Noisy le Grand, France

[21] Appl. No.: 170,807

[22] Filed: Dec. 21, 1993

[30] Foreign Application Priority Data

Jan. 22, 1993 [FR] France ..... 93 00633

[51] Int. Cl.[6] ..... B41E 15/46

[52] U.S. Cl. ..... 101/123; 101/120; 118/413

[58] Field of Search ..... 101/114, 120, 123, 124, 101/157, 169; 118/413

[56] References Cited

U.S. PATENT DOCUMENTS

| | | | |
|---|---|---|---|
| 3,886,861 | 6/1975 | Anselrode | 101/123 |
| 3,901,146 | 8/1975 | Stierlein | 101/120 |
| 4,102,266 | 7/1978 | Porth | 101/124 |
| 4,817,524 | 4/1989 | Riemer | 101/123 |
| 4,903,594 | 2/1990 | Ercole | 101/123 |
| 4,949,636 | 8/1990 | Tachibana | 101/123 |
| 4,995,316 | 2/1991 | Kölblin et al. | 101/123 |
| 5,201,452 | 4/1993 | Takahashi et al. | 101/114 |
| 5,239,922 | 8/1993 | Zimmer | 101/120 |

FOREIGN PATENT DOCUMENTS

| | | |
|---|---|---|
| 0505020 | 9/1992 | European Pat. Off. . |
| 2615789 | 12/1988 | France . |
| 2317213 | 10/1974 | Germany . |
| 3912096 | 10/1990 | Germany . |

*Primary Examiner*—Edgar S. Burr
*Assistant Examiner*—Stephen R. Funk
*Attorney, Agent, or Firm*—Young & Thompson

[57] ABSTRACT

A squeegee head includes a squeegee carried by a squeegee-holder carried by a support and whose inclination on the support is adjustable by rotation about a pivot axis parallel to the lengthwise direction of the squeegee. The squeegee-holder pivot axis is substantially coplanar with the free edge of the squeegee. The squeegee heads finds a specific application in silkscreen printing machines.

13 Claims, 2 Drawing Sheets

SQUEEGEE HEAD, IN PARTICULAR FOR SILKSCREEN PRINTING MACHINES

BACKGROUND OF THE INVENTION

1. Field of the Invention

The present invention is generally concerned with squeegee heads of the type used in silkscreen printing machines, for example, for forcing the ink through the screen and for cleaning the screen.

2. Description of the prior art

A known squeegee head of this kind includes a squeegee carried by a squeegee-holder itself carried by a support. The squeegee is designed to be swept across the silk screen in one direction, pushing in front of it the ink to be forced through the screen, and is usually associated with a second squeegee which is swept in the opposite direction to clean the screen.

In practice the squeegee is applied to the screen at a particular angle in order to improve the sweeping action.

In addition to other factors including the mesh size of the screen, the so-called "contact free" distance between the screen and the object to be printed and the hardness of the squeegee, the angle at which the squeegee is applied to the screen is one parameter determining the thickness of the ink deposit on the object to be printed.

Good control of this thickness is essential in multicolor printing because the translucent colors are laid down in succession and the final color depends on the thickness of the ink deposit. To achieve good control of this thickness it is important to be able to vary the angle at which the squeegee is applied to the screen at will and to be able to adjust it accordingly.

In current squeegee heads the squeegee-holder is therefore mounted on its support so that its inclination can be adjusted by rotating it about a pivot axis parallel to the lengthwise direction of the squeegee.

At present, however, this pivot axis is at a relatively large distance from the free edge of the squeegee, the squeegee-holder being merely articulated to its support by a pivot.

Consequently, any modification of the squeegee angle modifies the height of the free edge of the squeegee and therefore the contact pressure with which the squeegee is applied to the screen.

If the contact pressure is too high, the printed object is over-inked and each dot printed on it spreads excessively, whereas if the contact pressure is too low there may be localized gaps in the printing.

Thus at present changing the squeegee angle requires modification of its height.

This complicates the adjustments required.

A general object of the present invention is an arrangement which can avoid this problem and confer other advantages.

SUMMARY OF THE INVENTION

The present invention consists in a squeegee head, in particular for silkscreen printing machines, comprising a squeegee carried by a squeegee-holder carried by a support and adjustable in inclination on said support by rotation about a pivot axis parallel to the lengthwise direction of said squeegee and substantially level with the free edge of said squeegee, in which head the inclination of said squeegee-holder on its support is varied by a motor carried by said support which comprises a screwthreaded rod perpendicular to said lengthwise direction of said squeegee rotated by said motor and which meshes with a screwthreaded nut prevented from rotating relative to said support and interengaged by means of at least one recess with at least one drive finger on said squeegee-holder parallel to said lengthwise direction of said squeegee.

For example, the support includes a guide track perpendicular to the lengthwise direction of the squeegee and extending along a circular arc substantially centered on the free edge of the squeegee and the squeegee-holder is interengaged with the guide track by follower means.

In accordance with the invention the squeegee angle is adjusted by rotation about the free edge of the squeegee, this adjustment advantageously causing no modification in the height of the free edge and therefore of the squeegee.

In other words, it advantageously does not change the contact pressure between the squeegee and the screen.

The resulting independence of the squeegee angle adjustment and the contact pressure between the squeegee and the screen has the advantage that it enables the adjustment to be carried out with the printing machine in operation.

Thus in accordance with a particularly advantageous feature of the invention the inclination of the squeegee-holder on its support is varied by a motor carried by said support.

In this way it is possible, before series printing is started, to adjust the squeegee angle with the printing machine in operation until the required printed colors are obtained, as assessed visually, without stopping the printing machine and therefore to the benefit of productivity.

The features and advantages of the invention emerge from the following description given by way of example with reference to the appended diagrammatic drawings.

DETAILED DESCRIPTION OF THE PREFERRED EMBODIMENT

Figure 2:
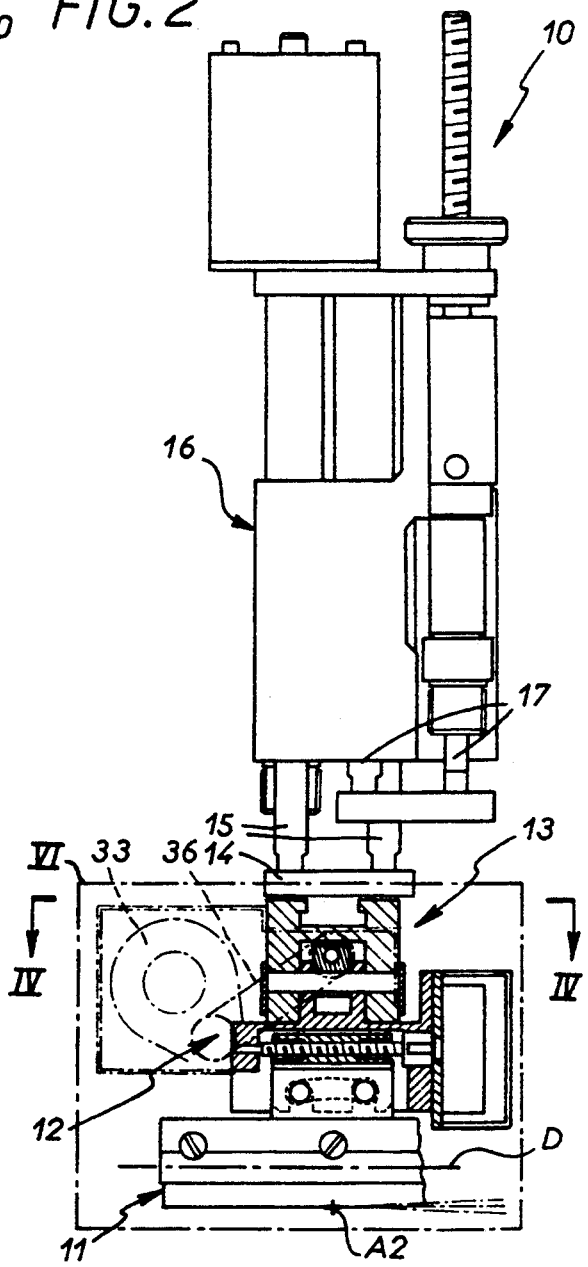
FIG. 2 is a locally cut away side view of it as seen in the direction of the arrow II in FIG. 1.
Figure 6:
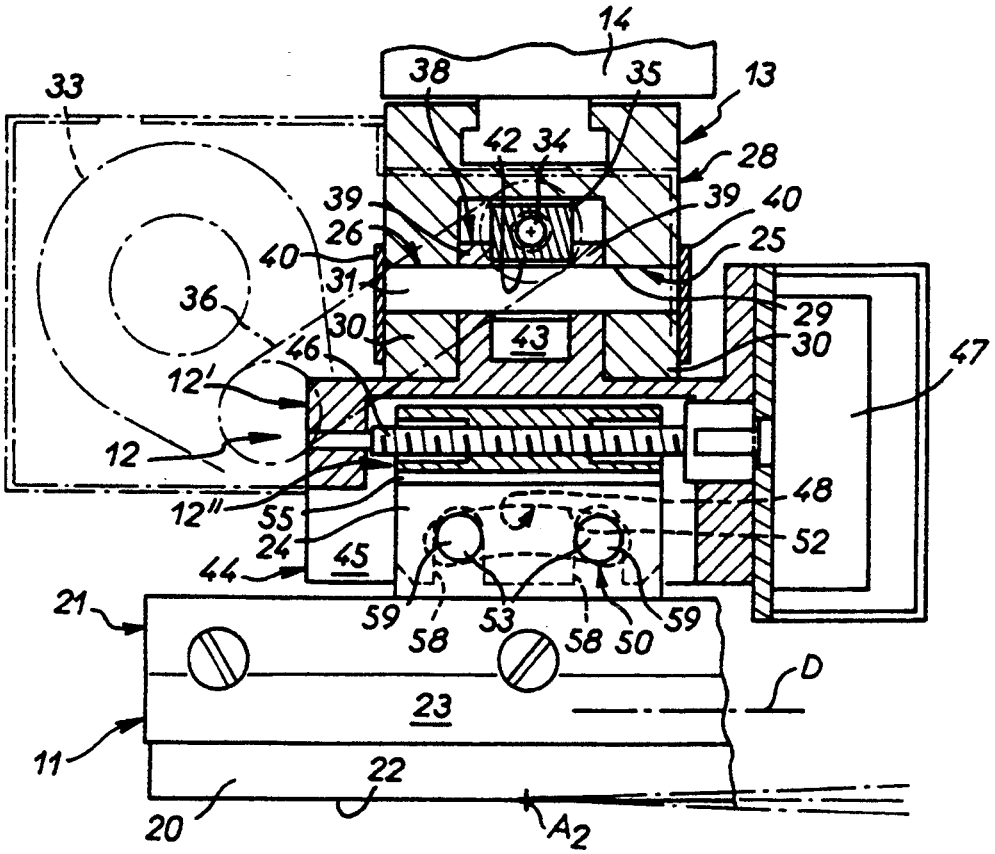
FIG. 6 shows to the same scale as FIG. 5 the part of FIG. 2 identified by the frame VI in FIG. 2.

Referring to the figures, the squeegee head 10 in accordance with the invention generally comprises, in the known manner, a squeegee 11 which is adapted to be disposed transversely to a silk screen (not shown) and extending in a lengthwise direction D shown by a chain-dotted line in FIGS. 2 and 6. As described in more detail later, it is carried by a squeegee-holder 12 in turn carried by a support 13.

The support 13 is attached to a plate 14 by a dovetail type joint perpendicular to the lengthwise direction D of the squeegee 11 and the plate 14 is in turn attached to the end of columns 15 which slide vertically on a frame 16 which in a similar manner carries at the end of columns 17 a plate 18 adapted to support a cleaner squeegee (not shown).

The frame 16 is part of a printing station of a printing machine.

Figure 5:
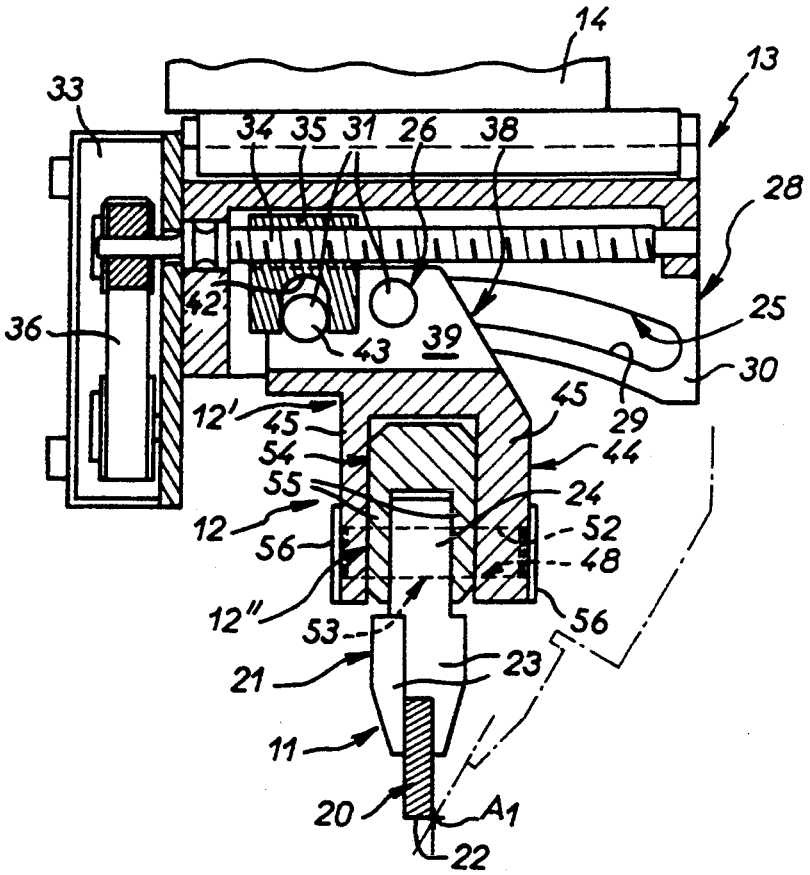
FIG. 5 shows to a larger scale the part of FIG. 1 identified by the frame V in FIG. 1.

The squeegee 11 comprises a flexible blade 20 in a rigid clamp 21 (see FIGS. 5 and 6).

The flexible blade 20 is generally parallelepiped-shape and its free edge, which constitutes the free edge 22 of the squeegee 11, has a finite width. As an alternative to this, however, the free edge could be bevelled to a greater or lesser degree.

The rigid clamp 21 is formed by two jaws 23 one of which has on the back a rib 24 by means of which the assembly is engaged with the squeegee-holder 12.

In the known manner the inclination of the squeegee-holder 12 relative to the support 13 is adjustable by rotation about a pivot axis A1 parallel to the lengthwise direction D of the squeegee 11.

Figure 1:
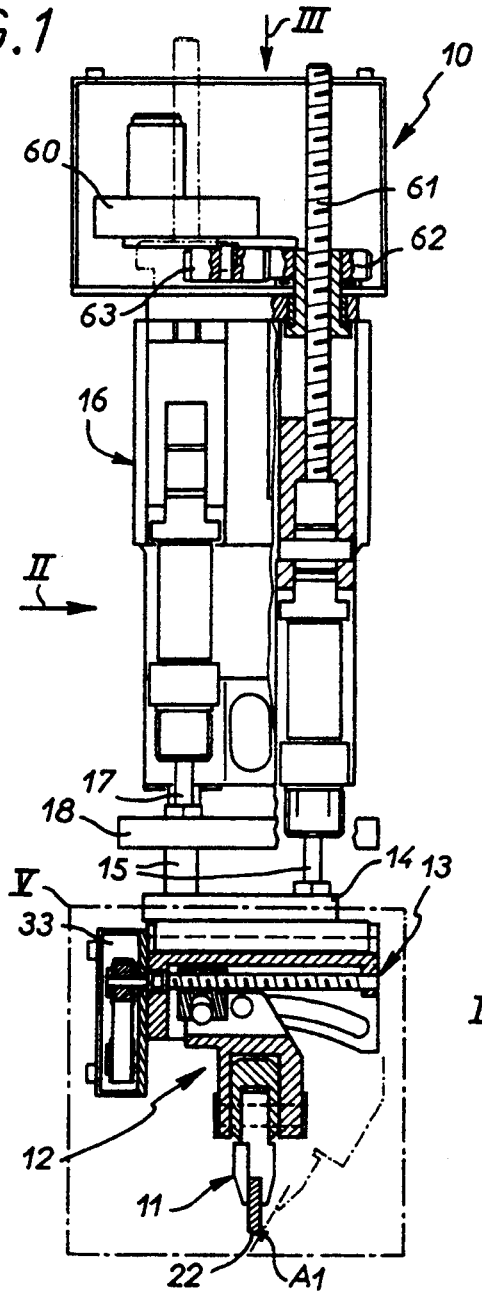
FIG. 1 is a locally cut away elevation and cross-section view of a squeegee head in accordance with the invention.

The pivot axis A1 is shown in FIGS. 1 and 5. According to the invention it is substantially aligned with the free edge 22 of the squeegee 11.

To be more precise, it is substantially coincident with the leading edge of the flexible blade 20 of the squeegee 11.

The support 13 of the squeegee-holder 12 includes a guide track 25 in a plane perpendicular to the lengthwise direction D of the squeegee 11. Extending along a circular arc it is substantially centered on the free edge 22 of the squeegee 11. The squeegee-holder 12 is interengaged with the guide track 25 by follower means 26.

The support 13 includes a yoke 28 with which the squeegee-holder 12 is slidably interengaged and its guide track 25 includes a slot 29 in each branch 30 of the yoke 28.

The follower means 26 of the squeegee-holder 12 comprise two spaced parallel rods 31 parallel to the lengthwise direction D of the squeegee 11 with their ends slidably interengaged with the slots 29 in the support 13.

The inclination of the squeegee-holder 12 on its support 13 is preferably (and as shown here) varied by a motor 33 carried by the support 13.

The support 13 includes a screwthreaded rod 34 between the branches 30 of the yoke 28 and perpendicular to the lengthwise direction D of the squeegee 11. The rod 34 is rotated by the motor 33 and meshes with a screwthreaded nut 35 which is prevented from rotating relative to the support 13.

The motor 33 is in practice a motor-gearbox unit and drives the rod 34 through a belt and pulley-wheel transmission system 36.

The squeegee-holder 12 is slidably interengaged with the support 13 by means of a yoke 38 parallel to the rod 34 between the branches 30 of the yoke 28 of the support 13.

The rods 31 extend between the branches 30 of the yoke 28 of the support 13 and pass without clearance through the branches 39 of the yoke 38 of the squeegee-holder 12.

To prevent them escaping plates 40 are attached in line with them to the external surfaces of the branches 30 of the yoke 28 of the support 13.

The nut 35 is slidably interengaged with and extends between the branches 39 of the yoke 38 of the squeegee-holder 12 and is prevented from rotating relative to the support 13 by the squeegee-holder 12.

The nut 35 is interengaged by means of at least one recess 42 with at least one drive finger 43 parallel to the lengthwise direction D of the squeegee 11 carried by the squeegee-holder 12.

Here the nut 35 has only one recess 42 in the form of a notch by means of which it is engaged over one of the rods 31.

Thus the drive finger 43 is here formed by the corresponding part, namely the median part, of the rod 31.

The nut 35 is interengaged with the drive finger 43 without clearance in the direction parallel to the rod 34 and with clearance in the direction perpendicular to the latter.

The squeegee 11 is mounted on the squeegee-holder 2 for adjustment of its parallel relationship to the screen by rotation about a pivot axis A2 perpendicular to its lengthwise direction D and substantially level with its free edge 22.

The pivot axis A2 is shown in FIGS. 2 and 6.

It is transverse to and substantially coplanar with the free edge of the flexible blade 20 forming the free edge 22 of the squeegee 11.

The squeegee-holder 12 is in two parts, namely a first part 12' which includes the yoke 38 and is slidably engaged with the support 13, as previously described, and a second part 12'' which carries the squeegee 11.

The first part 12', back-to-back with the yoke 38 but at right-angles to it, forms a yoke 44 with the branches 45 of which the second part 12'' is slidably interengaged and includes, between the branches 45 of the yoke 44 and parallel to the lengthwise direction D of the squeegee 11, a screwthreaded rod 46 which is rotated by a motor 47 carried by the first part 12' and with which the second part 12'' meshes.

The second part 12'' is therefore mobile on the first part 12' in the direction parallel to the lengthwise direction D of the squeegee 11.

The first part 12' further includes a guide track 48 parallel to the lengthwise direction D of the squeegee 11 and extending along a circular arc substantially centered on the free edge 22 of the squeegee 11 along the pivot axis A2 and the squeegee 11 is interengaged with the guide track 48 by follower means 50.

The guide track 48 of the first part 12' includes a slot 52 in each branch 45 of its yoke 44 and the follower means 50 of the squeegee 11 include two spaced parallel rods 53 perpendicular to the lengthwise direction D of the squeegee 11 and with their ends slidably interengaged with the slots 52 in the yoke 44 of the first part 12'.

The second part 12'' forms a yoke 54 with the branches 55 of which the squeegee 11 is slidably interengaged by way of the rib 24 on its rigid clamp 21.

The rods 53 forming the follower means 50 of the squeegee 11 extend between the branches 45 of the yoke 44 of the first part 12', passing without clearance through the rib 24 on the rigid clamp 21 of the squeegee 11.

To prevent them escaping plates 56 are attached level with them to the outside surfaces of the branches 45 of the yoke 44 of the first part 12'.

The second part 12'' is interengaged by way of at least one recess 58 with at least one drive finger 59 on the squeegee 11 perpendicular to its lengthwise direction D.

The second part 12'' as shown here includes two spaced recesses 58 in the form of notches by means of which the second part 12'' is interengaged with the rods 53 forming the follower means 50 of the squeegee 11.

As previously, the drive fingers 59 are therefore formed by a part of the rods 53.

It follows from the foregoing description that the parallel alignment of the squeegee 11 on the squeegee-holder 12 is varied by the motor 47 carried by the first part 12' of the squeegee-holder 12.

Figure 3:
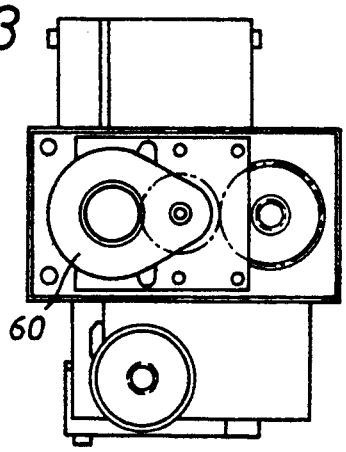
FIG. 3 is a partial plan view of it as seen in the direction of the arrow III in FIG. 1.
Figure 4:
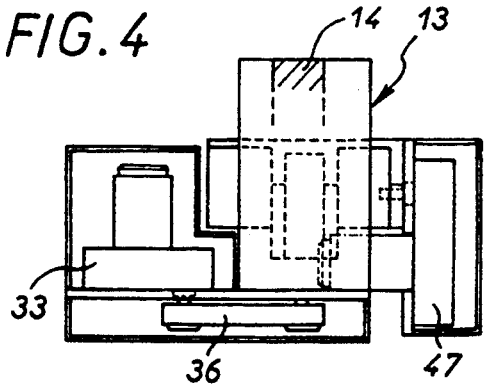
FIG. 4 is a partial plan view of it in cross-section on the line IV—IV in FIG. 2.

The height of the support 13 of the squeegee-holder 12 on the frame 16 can be adjusted by a motor 60 carried by the latter (see FIGS. 1 and 3).

One of the columns 15 carrying the plate 14 to which the support 13 is attached to this end has a screwthreaded portion 61 rotated by a gear 62 driven by a motor 60 via a gear 63.

As before, the motor 60 is in practice a motor-gearbox unit.

Because of the motor 33 it is advantageously possible to adjust the inclination of the squeegee-holder 12 relative to its support 13 while the printing machine is operating, for example to change from the position of the squeegee-holder 12 shown in full line in FIGS. 1 and 5 in which the squeegee 11 is substantially perpendicular to the associated screen to the position of the squeegee-holder 12 shown in chain-dotted line in FIGS. 1 and 5 in which the squeegee 11 is oblique to the screen.

The corresponding rotation is about the pivot axis A1.

This rotation may be through at least 30 degrees on either side of a vertical plane passing through the pivot axis A1, for example.

As the pivot axis A1 is co-incident with the leading edge of the squeegee 11, adjusting the inclination of the squeegee-holder 12 has no effect on the contact pressure with which the squeegee 11 is applied to the underlying screen.

If required the contact pressure can be modified with the printing machine in operation by means of the motor 60.

The motor 47 modifies the parallel relationship of the squeegee 11 to the screen by rotating the squeegee 11 in a plane perpendicular to the screen about the pivot axis A2.

This rotation may be through a few degrees (1 to 3 degrees) relative to the plane of the screen, for example.

Of course, the present invention is not limited to the embodiment described and shown but encompasses any variant execution thereof.

There is claimed:

1. Squeegee head, in particular for silkscreen printing machines, comprising a squeegee carried by a squeegee-holder, said squeegee-holder carried by a support, means for adjustably mounting said squeegee-holder on said support for rotation about an axis parallel to a lengthwise direction of said squeegee and substantially at an operative free edge of said squeegee, motor means for varying the inclination of said squeegee-holder, said motor means comprising a motor carried by said support, a screw threaded rod perpendicular to said lengthwise direction and driven for rotation by said motor, and a screw threaded nut meshing with said screw threaded rod and held against rotation relative to said support, said screw threaded nut being interengaged by means of at least one recess with at least one drive finger on said squeegee-holder parallel to said lengthwise direction of said squeegee.

2. Squeegee head according to claim 1 wherein said screwthreaded nut is interengaged with said drive finger of said squeegee-holder without clearance in a direction parallel to said screwthreaded rod and with clearance in a direction perpendicular to said screwthreaded rod and perpendicular to said lengthwise direction.

3. Squeegee head according to claim 1 wherein said squeegee-holder includes a yoke having branches parallel to said screwthreaded rod and said screwthreaded nut is slidably interengaged with the branches of said yoke.

4. Squeegee head according to claim 1 wherein said squeegee-holder support comprises a guide track perpendicular to said lengthwise direction of said squeegee extending along a circular arc substantially centered on said free edge of said squeegee and said squeegee-holder is interengaged with said guide track by follower means.

5. Squeegee head according to claim 4 wherein said squeegee-holder support includes a yoke having branches with which said squeegee-holder is slidably interengaged and said guide track of said support includes a slot in each branch of said yoke wherein said follower means of said squeegee-holder comprise two spaced parallel rods parallel to said lengthwise direction of said squeegee and with their ends slidably interengaged with said slots of said support.

6. Squeegee head according to claim 5 wherein said drive finger of said squeegee-holder is formed by a part of one of said rods forming said follower means.

7. Squeegee head according to claim 1 wherein said squeegee-holder support includes a yoke having branches, said squeegee-holder being slidably engaged with said branches and said guide track of said support including a slot in each of the branches of said yoke.

8. Squeegee head according to claim 1, comprising means for adjustably mounting said squeegee on said squeegee-holder for rotation about a pivot axis perpendicular to said lengthwise direction of said squeegee and substantially at said operative, free edge of said squeegee whereby said squeegee is adjustable in parallel relationship to a screen.

9. Squeegee head according to claim 8 wherein said squeegee-holder is in two parts and has a first part slidably interengaged with said support and a second part mobile on said first part parallel to said lengthwise direction of said squeegee and carrying said squeegee, said first part has a guide track parallel to said lengthwise direction of said squeegee extending along a circular arc substantially centered on the free edge of said squeegee and said squeegee is interengaged with said guide track by follower means.

10. Squeegee head according to claim 9 wherein the position of said squeegee on said squeegee-holder is varied to adjust the parallel relationship of said squeegee to said screen by a motor carried by said first part of said squeegee-holder.

11. Squeegee head according to claim 10 wherein said first part of said squeegee-holder forms a first yoke having branches, said second part being slidably interengaged with said branches, said first part comprising a screwthreaded rod parallel to said lengthwise direction of said squeegee and said screwthreaded rod meshing with said second part which forms a second yoke having branches, said squeegee being slidably interengaged with said branches of said second yoke, said guide track of said first part including a slot in each of the branches of said first yoke and said second part being interengaged by means of at least one recess with at least one finger on said squeegee perpendicular to said lengthwise direction.

12. Squeegee head according to claim 11 wherein said follower means of said squeegee include two spaced parallel rods perpendicular to said lengthwise direction of said squeegee with their ends slidably engaged with said slots of said first part of said squeegee-holder and said at least one finger of said squeegee is formed by a part of said rods.

13. Squeegee head according to claim 1, further comprising a frame, another motor means carried by said frame for varying the height of said support on said frame.

* * * * *